US006886727B2

(12) United States Patent
Moore

(10) Patent No.: US 6,886,727 B2
(45) Date of Patent: May 3, 2005

(54) DETACHABLE BACK PACK WAIST BELT

(75) Inventor: Michael Moore, Redding, CA (US)

(73) Assignee: Talons Adventure Gear, Inc., Redding, CA (US)

( * ) Notice: Subject to any disclaimer, the term of this patent is extended or adjusted under 35 U.S.C. 154(b) by 0 days.

(21) Appl. No.: 10/117,383

(22) Filed: Apr. 5, 2002

(65) Prior Publication Data

US 2002/0145028 A1 Oct. 10, 2002

Related U.S. Application Data

(60) Provisional application No. 60/282,523, filed on Apr. 7, 2001.

(51) Int. Cl.[7] ..... A45F 3/08; A45F 3/04

(52) U.S. Cl. ..... 224/637; 224/262

(58) Field of Search ..... 224/262, 637, 224/153, 647, 648

(56) References Cited

U.S. PATENT DOCUMENTS

| | | | | | |
|---|---|---|---|---|---|
| 3,840,162 | A | * | 10/1974 | Horenstein et al. | 224/25 A |
| 3,902,640 | A | * | 9/1975 | Geiben | 224/8 R |
| 4,307,826 | A | * | 12/1981 | Stewart | 224/253 |
| 4,318,502 | A | * | 3/1982 | Lowe et al. | 224/153 |
| 5,429,287 | A | * | 7/1995 | Frano | 224/215 |
| 5,564,612 | A | * | 10/1996 | Gregory | 224/633 |
| 5,797,529 | A | * | 8/1998 | Lavine | 224/575 |
| 5,954,253 | A | * | 9/1999 | Swetish | 224/631 |
| 5,957,354 | A | * | 9/1999 | Mentken | 224/614 |
| 5,964,384 | A | * | 10/1999 | Young | 224/153 |
| 6,079,602 | A | * | 6/2000 | Howell | 224/637 |
| 6,098,859 | A | * | 8/2000 | Bortner | 224/272 |
| 6,179,175 | B1 | * | 1/2001 | Painter | 224/153 |
| 6,199,732 | B1 | * | 3/2001 | Swetish | 224/262 |
| 6,431,424 | B1 | * | 8/2002 | Smith | 224/583 |

FOREIGN PATENT DOCUMENTS

| | | | |
|---|---|---|---|
| FR | 2586539 A1 | * | 3/1987 |
| GB | 2270832 A | * | 3/1994 |
| JP | 1156472 | * | 3/1999 |

* cited by examiner

*Primary Examiner*—Sue A. Weaver
(74) *Attorney, Agent, or Firm*—John P. O'Banion

(57) ABSTRACT

A detachable waist belt for use with book bags and day packs significantly reduces the problems associated with carrying too much weight on the back. The waist belt and clamping system provide a retrofit system usable with any backpack or book bag. The system is especially beneficial to school children who are increasingly carrying too much weight in book bags.

10 Claims, 2 Drawing Sheets

DETACHABLE BACK PACK WAIST BELT

CROSS-REFERENCE TO RELATED APPLICATIONS

This application claims priority from U.S. provisional application Ser. No. 60/282,523 filed on Apr. 7, 2001.

BACKGROUND OF THE INVENTION

In the past it has been common practice to carry a pack on a person's back. Backpacks are used in a variety of applications including carrying camping supplies, books and even babies. Just about any heavy object that must be carried has been carried in a back pack.

Backpacks typically are equipped with two shoulder straps. Typically the weight of the pack hangs from these two straps from the shoulders of the user. Suspending too much weight from the shoulders over an extended period has been shown to be detrimental to the back causing problems ranging from simple discomfort and fatigue to spinal compression, back pain and misalignment of the spine. The problem has been aggravated in recent years as young children have been carrying overweight book packs. It has been suggested that a child carry no more than 15% of their body weight on their back. Children from grade school through high school and the university are carrying far in excess of this amount.

It has been known practice to manufacture hiking back packs, baby carriers and some high end day packs with a waist belt built in. The waist belt allows a portion of the pack weight to be distributed to the hips of the wearer. This arrangement has advantages in that it avoids putting a portion of the load on the spine. Most day use packs and school back packs have no supporting waist belt at all. However, a waist belt has not been used in combination with a book pack where there is no frame, and a detachable waist belt has not been used in combination with a day pack, book bag or school back pack.

SUMMARY OF THE INVENTION

A principle object of the invention is to provide a detachable waist belt for use in combination with a book bag or back pack.

A further object is to provide a waist belt that can be used with a book bag or back pack that has no frame.

A further object of the invention is to provide a detachable waist belt that will effectively redistribute the weight of a backpack to the hips of the user and that can be clamped to any book bag or backpacks having shoulder straps, thus allowing the user to move the belt to a different book bag as children are known to change their book bag several times during their school years.

A further object of the invention is to provide a detachable waist belt that has structure conforming to the hips of the user.

DETAILED DESCRIPTION

Figure 1:
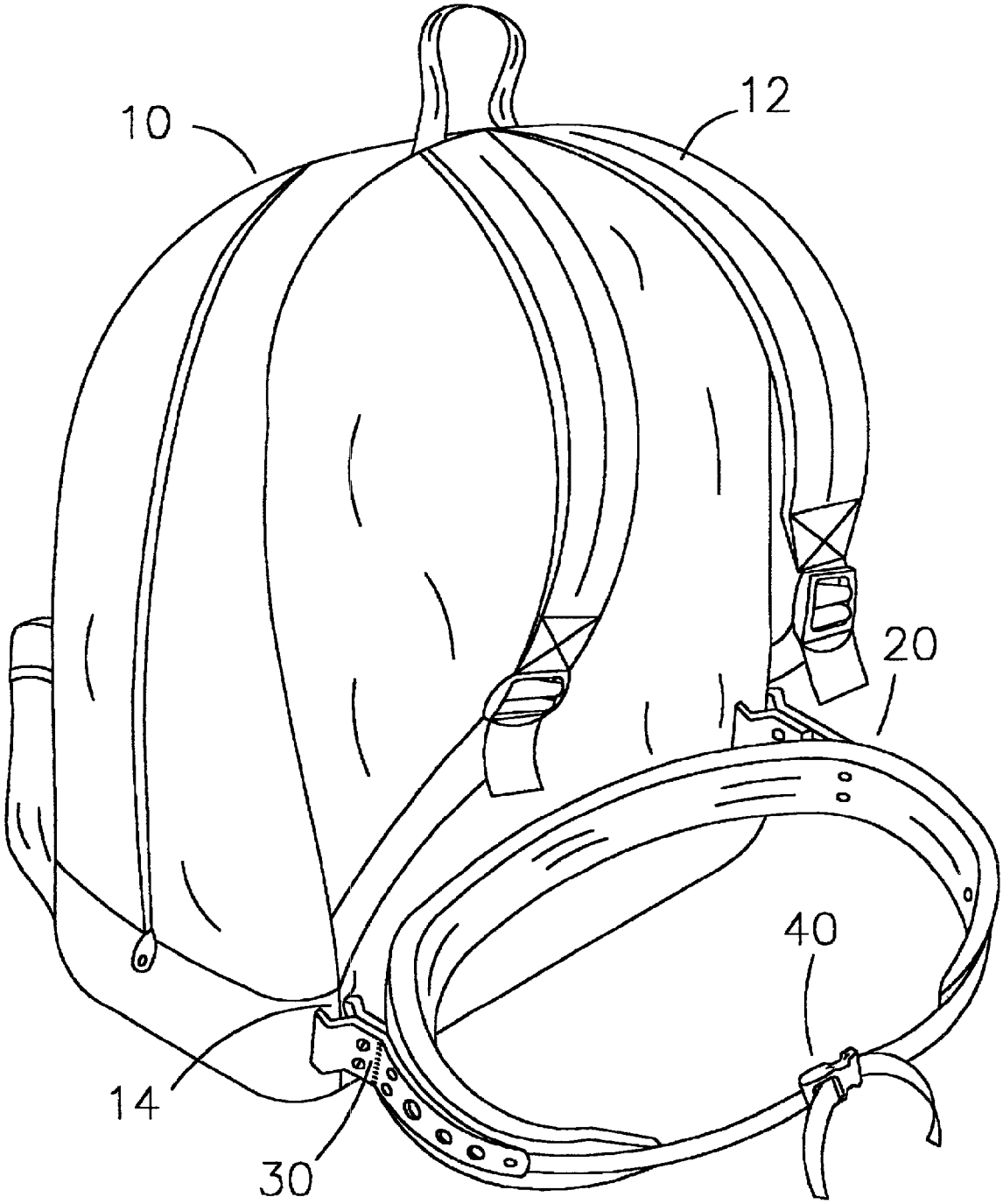
FIG. 1 is an view of a back pack with the waist belt clamped in place

FIG. 1 shows a back pack (10) with the waist belt (20) attached. The back pack (10) is of the type that school children commonly use to carry books. Two padded shoulder straps (12) are sewn to the top and bottom of the pack. The waist belt (20) attaches to the vertical seam just below where the shoulder strap (12) near the point (14) where it is sewn to the pack (10). The belt (20) is attached using two identical clamps (30) which grip the pack (10). The belt (20) fits around the user and is clasped using a typical belt closure device (40).

Figure 2:
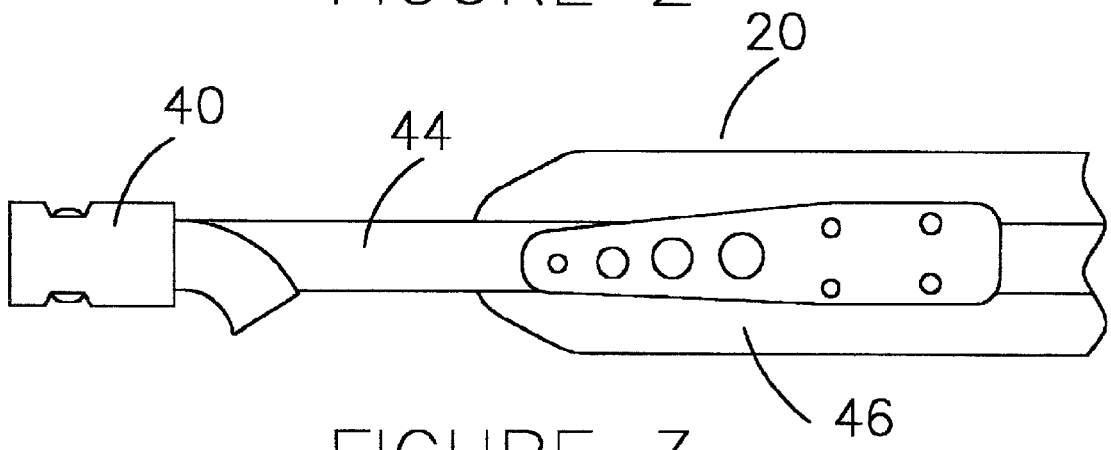
FIG. 2 is a view of one end of the waist belt

FIG. 2 shows additional details of the belt (20). One end of the belt (20) is shown including half of the closure device (40). The belt (20) includes a narrow section (44) made of webbing and a wide padded section (46). The narrow section of belt (44) is held to the padded section (46) by stitching. The clamping device (30) is attached to the padded portion by rivets (48).

Figure 3:
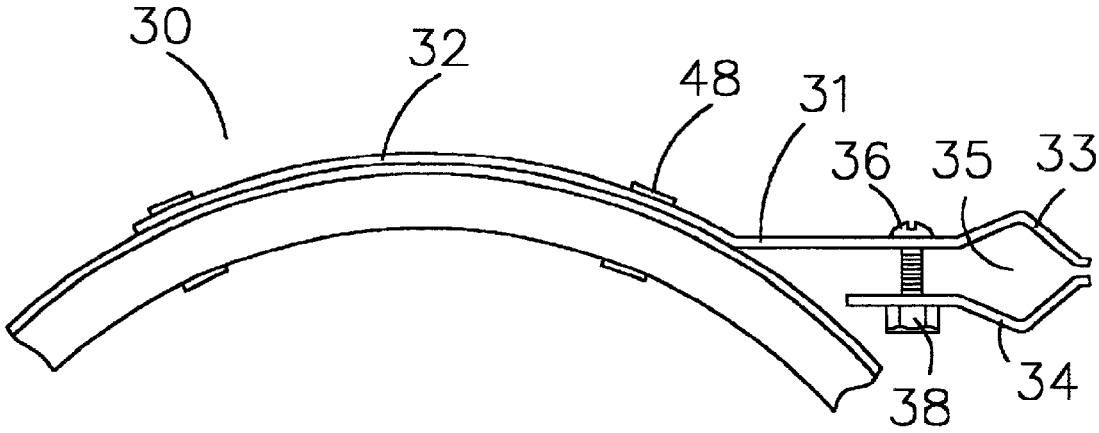
FIG. 3 is a view of the waist conforming mounting structure of the belt

As shown in FIG. 3 the clamp (30) includes a long section (32) which has a curved shape designed to make it fit the contour of the hip of a wearer. The section (31) also includes a sharp bend in one end (33). This sharp bend cooperates with a second piece (34) to create an opening (35) into which material from the backpack and seam will be held. The bolt (36) and nut (38) cooperate to hold the clamp the pieces (33) and (34) together and to hold them to the pack (10).

Figure 4:
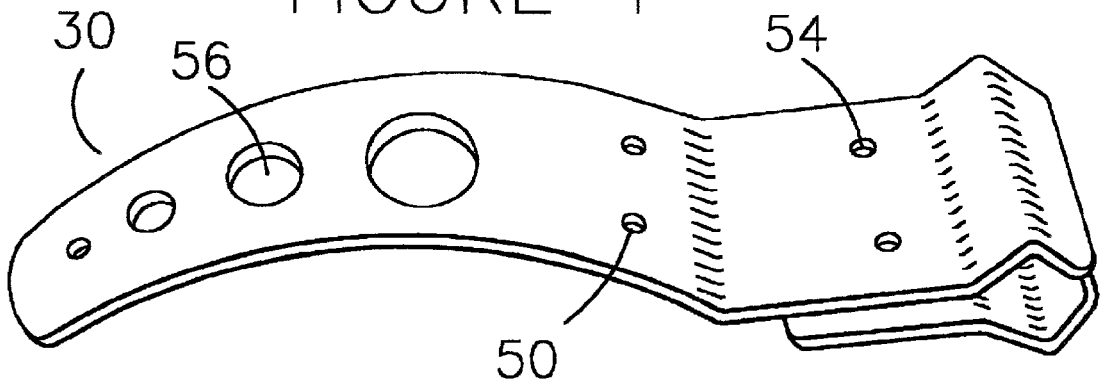
FIG. 4 is an view of one clamp

FIG. 4 shows another view of the clamp (30) detailing the rivet holes (50), bolt holes (54) as well as weight reducing holes (56).

In use the belt (20) is held against the pack (10) with the bolts (36) slightly loose. Material from the lower vertical seam (14) of the pack (10) is held in the space (35) as the clamp is slid up the seam (14) to a point just below the shoulder strap. As bolt (36) is tightened the two sides (33) and (34) of the clamp are forced together and clamp onto the pack. This process is completed for each side of the pack. The wearer then places their arms through the shoulder straps (12) with the pack (10) on their back. The buckle (40) is closed and adjusted for the user. Once in place the section (32) should ride just above the hip bone of the wearer.

With the waist belt (20) attached to the pack (10) as described a substantial portion of the weight of the pack is transferred directly to the hips of the wearer. This is an ideal way to carry any load. Although shown in use with a frameless backpack the belt could be used with other types of devices including backpacks with frames and with child carriers. Also the belt can be used with many different packs. Children often change their book pack every year to keep up with changing fashions and because of wear, but the waist belt can be clamped to a new pack each year and the wearer can continue to benefit from it. Although shown in use with a bolt (36) any clamping arrangement could be used, for example a single action camming device could be used to secure the clamp in the closed position. Any device that would securely but releasably grip the backpack would work.

Having thus described the device what is claimed is:

1. A retrofit detachable waist belt apparatus for use with a backpack having shoulder straps, said waist belt comprising;

clamp means for gripping a fabric portion of a backpack;

means for releasing the clamp means from the backpack;

said waist belt including a flexible fabric portion adapted to at least partially encircle a wearer's waist;

said waist belt including a relatively rigid portion adapted to at least partially support the backpack adjacent to the waist of the wearer;

wherein the clamp means includes a threaded element that allows the wearer to attach and remove the waist belt from the backpack;

wherein said clamp means includes first and second sections which are moveable between open and closed positions, and wherein said first and second sections are adapted to grip the fabric portion of the backpack without penetrating the fabric portion of the backpack.

2. A retrofit detachable waist belt apparatus for use with a backpack having shoulder straps, said waist belt comprising:

clamp means for gripping a fabric portion of a backpack;

means for releasing said clamp means from the backpack;

said waist belt including a flexible fabric portion adapted to at least partially encircle a wearer's waist;

said waist belt including a relatively rigid portion adapted to at least partially support said backpack adjacent to the waist of the wearer;

wherein the relatively rigid portion of the waist belt is integrally formed with at least a portion of the clamp means;

wherein said clamp means includes first and second sections which are moveable between open and closed positions, and wherein said first and second sections are adapted to grip the fabric portion of the backpack without penetrating the fabric portion of the backpack.

3. A retrofit detachable support apparatus for use with a backpack having shoulder straps, comprising:

a waist belt;

said waist belt including a flexible fabric portion adapted to at least partially encircle a wearer's waist;

said waist belt including a relatively rigid portion adapted to at least partially support a backpack adjacent to the waist of the wearer;

clamp means associated with the waist belt for gripping a fabric portion of the backpack; and means for releasing the clamp means from the backpack;

wherein the clamp means includes a threaded element that allows the wearer to attach and remove the waist belt from the backpack;

wherein said clamp means includes first and second sections which are moveable between open and closed positions, and wherein said first and second sections are adapted to grip the fabric portion of the backpack without penetrating the fabric portion of the backpack.

4. A retrofit detachable support apparatus for use with a backpack having shoulder straps, comprising:

a waist belt;

said waist belt including a flexible fabric portion adapted to at least partially encircle a wearer's waist;

said waist belt including a relatively rigid portion adapted to at least partially support a backpack adjacent to the waist of the wearer;

clamp means associated with the waist belt for gripping a fabric portion of the backpack; and means for releasing the clamp means from the backpack;

wherein the relatively rigid portion of the waist belt is integrally formed with at least a portion of the clamp means;

wherein said clamp means includes first and second sections which are moveable between open and closed positions, and wherein said first and second sections are adapted to grip the fabric portion of the backpack without penetrating the fabric portion of the backpack.

5. A retrofit detachable support apparatus for use with a backpack having shoulder straps, comprising:

a waist belt;

said waist belt including a flexible portion adapted to at least partially encircle a wearer's waist; and a clamp;

said clamp including a relatively rigid portion attached to the flexible portion of the waist belt;

said relatively rigid portion of said clamp adapted to at least partially support a backpack adjacent to the waist of the wearer;

said clamp adapted to grip a fabric portion of the backpack;

said clamp including a threaded element configured to allow the wearer to attach and remove the waist belt from the backpack;

wherein said clamp includes first and second sections which are moveable between open and closed positions, and wherein said first and second sections are adapted to grip the fabric portion of the backpack without penetrating the fabric portion of the backpack.

6. A retrofit detachable support apparatus for use with a backpack having shoulder straps, comprising:

a waist belt;

said waist belt including a flexible portion adapted to at least partially encircle a wearer's waist; and a clamp;

said clamp including an integrally formed relatively rigid portion attached to the flexible portion of the waist belt;

said relatively rigid portion of said clamp adapted to at least partially support a backpack adjacent to the waist of the wearer;

said clamp having first and second sections moveable between open and closed positions which are adapted to grip a fabric portion of the backpack without penetrating the fabric portion of the backpack.

7. An apparatus as recited in claim 1, 2, 3, 4, 5 or 6, wherein said relatively rigid portion is configured to ride adjacent to the wearer's hip bone in use.

8. An apparatus as recited in claim 1, 2, 3, 4, 5, or 6, wherein said relatively rigid portion has a curvature to fit the waist of the wearer.

9. An apparatus as recited in claim 1, 2, 3, 4, 5 or 6, further comprising a section of padding that separates said relatively rigid portion from the wearer's waist and hips.

10. An apparatus as recited in claim 1, 2, 3, 4, 5 or 6, further comprising a closure device to secure the apparatus about the waist of the wearer.

* * * * *